US005491010A

United States Patent [19]

Eder

[11] Patent Number: 5,491,010

[45] Date of Patent: Feb. 13, 1996

[54] CONTAINER WITH A LABEL ADHERED TO THE CONTAINER

[75] Inventor: Erich Eder, Donaustauf, Germany

[73] Assignee: Krones AG Hermann Kronseder Maschinenfabrik, Neutraubling, Germany

[21] Appl. No.: 308,996

[22] Filed: Sep. 20, 1994

Related U.S. Application Data

[60] Division of Ser. No. 71,464, Jun. 2, 1993, which is a continuation-in-part of Ser. No. 820,132, Jan. 13, 1992, abandoned.

[30] Foreign Application Priority Data

Aug. 1, 1991 [DE] Germany ..... 41 25 472.4

[51] Int. Cl.[6] ..... B65D 23/08

[52] U.S. Cl. ..... 428/35.7; 215/12.1; 428/34.7; 428/347

[58] Field of Search ..... 428/34.7, 35.7, 428/200, 201, 203, 347, 34.6, 34.8, 34.9, 35.1; 156/358, 363, 446, 450, 458, 519, 521, 566, 568, 499, 583.1, 583.3

[56] References Cited

U.S. PATENT DOCUMENTS 4,272,311 6/1981 D'Angelo et al. .
4,416,714 11/1983 Hoffmann .
4,694,633 9/1987 Fujio et al. .
4,735,668 4/1988 Hoffmann et al. ..... 156/518
4,844,957 4/1989 Hoffmann .
4,977,002 12/1990 Hoffmann .

FOREIGN PATENT DOCUMENTS 57-23620 5/1982 Japan .

*Primary Examiner*—Robert A. Dawson
*Assistant Examiner*—David Reifsnyder
*Attorney, Agent, or Firm*—Ryan, Maki & Hohenfeldt

[57] ABSTRACT

Containers are transported on rotatable support plates which are arranged in a circle on a rotating turntable. The leading edge of a label is adhered to a container as it orbits past a vacuum-type label transfer drum. A curved guide which is tangential to the cylindrical body of the container as the orbiting and rotating container passes it causes the label to wrap completely around the container. One of a circular array of heat sealing elements which are rotating with the turntable adjacent each support plate is cammed radially outwardly of the turntable into contact with the region on the container where the trailing end overlaps the leading end of the cable. This fuses the ends of the labels together. The cam profile is adjustable in length to keep the time during which the heat sealing member is in contact with the label ends overlap constant independently of the rotational speed of the turntable.

3 Claims, 6 Drawing Sheets

CONTAINER WITH A LABEL ADHERED TO THE CONTAINER

This is a divisional of application Ser. No. 08/071,464 filed on Jun. 2, 1993 now allowed, which is a continuation-in-part of application Ser. No. 07/820,132, filed Jan. 13, 1992 now abandoned.

BACKGROUND OF THE INVENTION

The invention disclosed herein pertains to a method and apparatus for applying and sealing labels to containers and to the containers resulting from treatment with the method.

A machine for applying and sealing labels to containers is described in U.S. Pat. No. 4,694,633. In this machine, each container is supported on a rotating disk so that the container rotates, as it is carried by a turntable, to serve as a mandrel about which the label is wrapped. At the start of container rotation, a vacuum bar is driven into juxtaposition with the container periphery. The vacuum bar attracts the leading end of a label and carries the label around the container sufficiently for the trailing end of the label to overlap the leading end. At this time, the overlapped ends are subjected to a heating element or a jet of hot air which seals the trailing end to the leading end of the label. The vacuum bar is then withdrawn. This leaves a free space between the label and the container so the label fits loosely on the container. Thus, the additional step of heat shrinking the entire label onto the container is required. The machine is only suitable for applying labels which are heat-shrinkable. Heating the entire surface of the label on the container is expensive and can result in wrinkles developing in the label. The machine is also not suitable for labeling prefilled aerosol cans which cannot be heated safely. Moreover, the thin suction bar and associated control mechanism are costly to manufacture and are vulnerable to damage.

Another machine for wrapping labels around rotating containers is disclosed in U.S. Pat. No. 4,272,311. In this machine, containers are conveyed in a straight line past an application station where a web of labels is drawn from a supply roll. Adhesive is applied at the interface of the leading edge of the label and the container. The leading edge of the web is then pressed against the container by means of a revolving belt. The individual label is cut from the web only after the web is partially wrapped around the container. To provide time for cutting, the web is stopped with a clamping device and the label which is already in contact with the container is torn or cut from the web along a perforated web. The label is then continuously rotated by reason of being in contact with the belt until the label is completely wrapped around the container. The overlap region of the leading and trailing ends of the label can be joined by having previously applied adhesive to the trailing end of the label or the trailing end can be sealed to the leading end by applying heat to the overlapped region. One disadvantage of the machine is that the adhesive-coated label is not separated from the web until the label is partially wrapped around the container which requires that the web be stopped for severing the label. This is obviously disadvantageous in that the method is intermittent rather than continuous which results in its product output being low. When the machine is driven at higher speeds, there is not sufficient time allowed for a reliable fusion of the leading and trailing edges of the label to achieve a good seal. Consequently, applying adhesive to a large area on the inside of the label or to the outside of the container is often necessary. This is highly disadvantageous, particularly in the application of labels composed of thin and transparent film, for reasons of appearance. The known apparatus is not suitable for achieving high production rates of 40,000 to 80,000 bottles or cans per hour as is a common requirement in the beverage industry today.

U.S. Pat. No. 4,416,714 discloses applying an adhesive coated leading end of a label to a rotating container to effect wrapping of the label on the container. The label is secured by adhering the trailing end over the underlying leading end. Labels are fed, one at a time, to the containers from a vacuum drum. Heat shrinking of the edges of the label to the contour of the container is disclosed, but heat sealing the overlapped label ends in addition to having adhesive applied near the trailing end as is described herein is not disclosed.

Japanese Patent No. Sho 57-23620, published May 19, 1982, discloses wrapping a heat shrinkable label around a container and heat sealing the overlapping trailing and leading ends of the label. The top and bottom edges of the label are heat-shrunk to conform them to the contour of the container. A back-up bar is placed behind the overlapping ends, at least along the edges which extend over the contour, to allow pressing the overlapping ends together by a hot heat seal member or a cold member when the label ends are sealed with glue. There is no disclosure of how the heat sealing time can be held substantially constant for different container transport speeds as is described herein.

SUMMARY OF THE INVENTION

The general object of the invention is to provide a method and apparatus for applying labels comprised of sealable material to containers and to provide a container which is unique insofar as its relationship with the label is concerned.

A further object of the invention is to provide a labeling machine which is capable of high product output and is distinguished by its minimal cost and high reliability.

The new labeling method and machine exhibits a continuous method in which a label is cut from a label web, the leading edge is applied and adhered to a rotating container, the label is wrapped tightly onto the container with no intervening space, and the trailing edge of the label overlaps the leading edge and is sealed to the leading edge. The method requires using only a small amount of adhesive, applied either to the leading edge of the label or to the container, to attach the leading edge of the label to the container rotating it to cause wrapping of the label around the container. Only sufficient adhesive is used on the leading edge to ensure that the label does not slip from the container during wrapping. The label is actually secured about the container when the trailing end of the label overlaps the leading end and the overlap region is heat sealed. The result is an extremely fast labeling method which produces containers on which the label is smooth and attractive even though a very thin or transparent film-type label is used. The width or height, as opposed to the length, of the label can be dimensioned so that the upper and lower longitudinally extending edges of the label extend over radially inwardly tapered top and bottom margins of the container such that only the longitudinal edges, rather than the whole label, need to be heat shrunk to cause the edges to conform to the contour of the container. The adhesive selected to attach the leading edge of the label to the container is preferably one whose adhesive strength diminishes with time following sealing. This is permissible since the label is tightly conformed to the container surface by the tight wrapping and by shrinking the upper and/or the lower longitudinally extending edges. When suitable label material is used on containers composed of plastic material such as polypropylene and polyethylene, the adhesive can be a solvent such as methylene chloride that forms a tacky area when applied to the label or the container. This allows the label to be attached to the container for a short but sufficiently long time for the labels to be wrapped around the container but which provides for part of the adhesive effect to be dissipated after a few minutes or after longitudinal edges of the label are subjected to heat radiated from an electric heating element or from a jet of hot air projected on the edges of the label while the container is still rotating.

In any case, when only a short time elapses between completion of the label wrapping step and heat sealing the overlapping ends of the label, it is necessary that the trailing edge of the label remains on the container during that time. This is achieved by mechanically pressing the label against the container, for example, or preferably by attaching the label to the container tentatively with narrow adhesive strips applied in the region just behind the trailing edge but with overlapping leading and trailing edges, which are to be subject to heat sealing, kept free of adhesive. The advantage of having the adhesive near the trailing end of the label but not extending to the end is that only one layer of adhesive, the layer on the leading end, lies in the region where the ends overlap for heat sealing. The result is a more inconspicuous seal which is one objective of the invention.

When applying labels whose upper and lower longitudinal edges do not follow the contour of the container after the label is wrapped, it is advantageous for the unadhered lower and upper edge or edges of the label to be backed up or supported on the inside facing the container so that the overlapping ends of the label can be sealed along the full height or width of the label. This assures that the upper and lower edges of the label in the region of overlapping will not separate or split open when the edges are subjected to heat shrinking.

An important feature of the invention is that the sealing time for the labels can be held constant independent of the present operating speed of the machine. This allows the labeling machine to be incorporated into a production line which has preceding and subsequent processing stages without the quality of the sealed seam being adversely affected, that is, without the application of too much or too little heat when there are variations in the operating speed at the input or output side of the new labeling machine.

How the foregoing briefly mentioned features of the new labeling method, resulting article and machine are achieved and implemented, will appear in the following more detailed description of a preferred embodiment of the invention wherein reference is made to the accompanying drawings.

DESCRIPTION OF A PREFERRED EMBODIMENT

Figure 1:
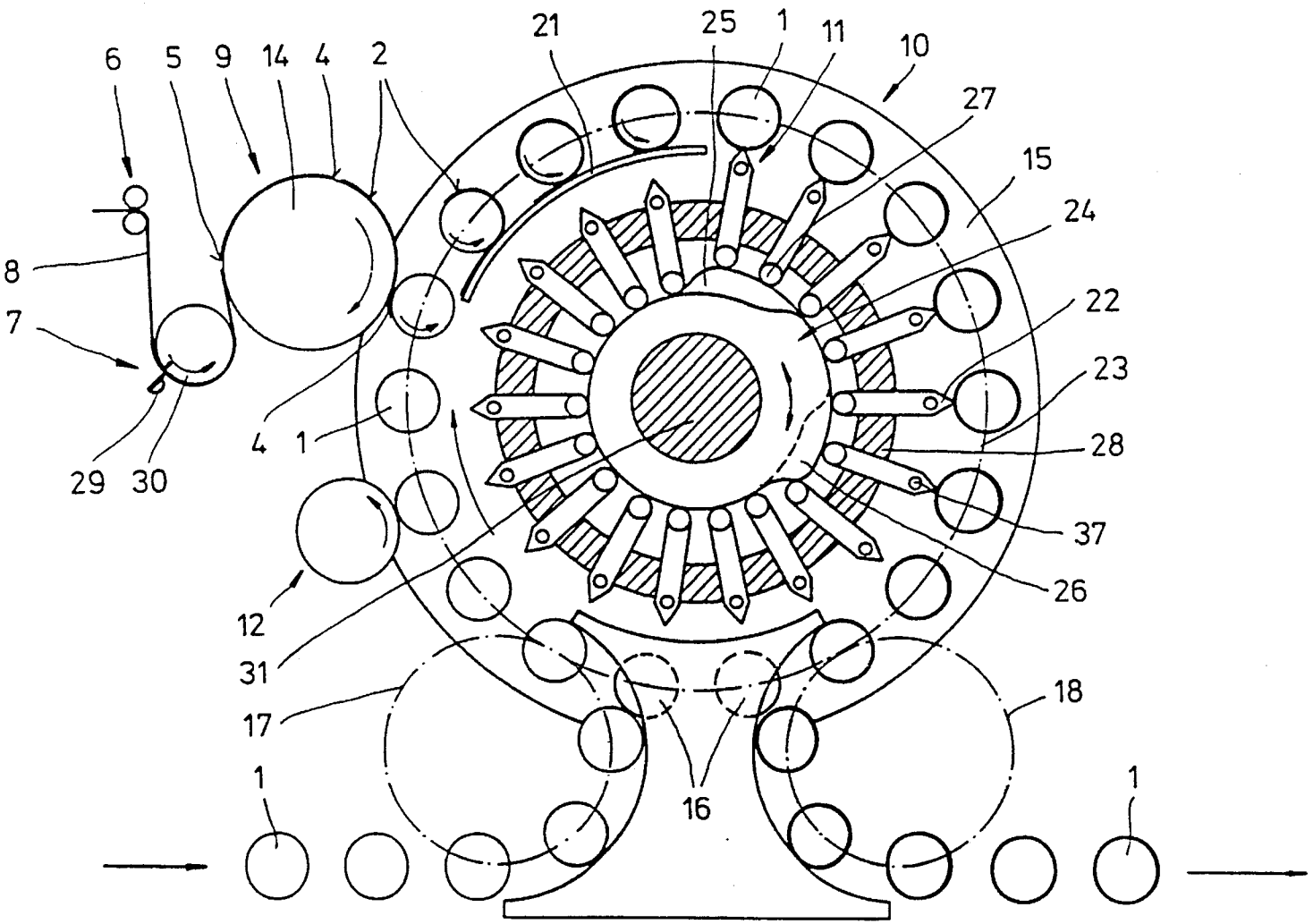
FIGS. 1–4 are schematic top plan views of the new labeling machine with its cover removed and respectively depicting four different embodiments of the invention.

The labeling machine illustrated in FIG. 1 has a turntable 15 which is driven rotationally about a vertical axis and carries several rotationally driven plates 16 which are shown in dashed line circles where they are not supporting a container 1 which is to be labeled. One of the dedicated control devices 20, depicted only in FIG. 9, which causes the respective rotary plates 16 to undergo a particular rotational sequence during a revolution of turntable 15. The containers 1 to be labeled are transferred to the rotary plates 16 in succession from a circular infeed conveyor 17 which is shown schematically. There is a conventional centering container stabilizing bell 19, shown in FIG. 9, for each rotary plate 6. The centering bell 19 can be raised and lowered with the help of which containers 1, after being transferred from infeed conveyor 17, are clamped with an axially directed force to the associated container supporting rotary plate 16.

Positioned in the region directly behind the infeed conveyor 17, radially outwardly of clockwise rotating turntable 15 is an adhesive applicator 12, commonly called a glue roller, which applies a strip of glue directly on the passing containers 1. The adhesive applicator 12 is basically a rotating roller which, when glass bottles or metal cans are the containers, applies preferably hot adhesive to the container or label or applies a solvent to the container or label when the container is composed of plastic material. The adhesive pattern formed on the container or label by the applicator 12 depends on the configuration of the surfaces of the container and the adhesive roller. If the body of the container and the periphery of the adhesive applicator roller are cylindrical, they make a tangential contact along a line which results in a narrow vertical strip of adhesive being transferred to the container. When hot melt adhesive is used, it is only necessary to apply adhesive to a few points to the leading edge of the label to hold it in place so that the adhesive applicator roller will have several projecting annular lands, not visible, axially spaced apart one above the other. The resulting glue pattern in such case is illustrated by the three adhesive strips depicted in FIG. 8.

Upstream of glue applicator 12 in the rotational direction of the turntable 15, a label transfer device 9 is positioned for depositing individual labels 2, which have been separated from a roll of labels, on containers 1. The label transfer device 9 in this particular embodiment constitutes a rotationally driven vacuum cylinder 14 which rotates synchronously with turntable 15 and, in this embodiment, in the same direction. The labels 2, which are cut to size already, cling to vacuum cylinder 14 after having been separated from an incoming web of labels by a cutting device 7 positioned adjacent the vacuum cylinder 14. The web is fed through web delivery pinch rolls 6 at a rate which is synchronous with the machine output from a supply roll, not shown, so that the labels 2 are positioned with their graphics facing the vacuum cylinder. The device which severs the individual labels from the web consists of a stationary blade 29 and a rotating blade 30 on the rotating vacuum cylinder.

Oppositely of the main vacuum cylinder 14 and radially inwardly of the rotary plate 16 orbit 23 there is a curved stationary guide element 21 whose outer surface lies adjacent the containers 1. As the labels 2 are wrapped about the containers in succession, guide element 21 guides the free end of the label which is not yet on the container 1 and simultaneously pulls the label taut so that it fits tightly on the container. The guide element 21 is preferably supplied with vacuum orifices, not shown, to enhance attraction of the labels. The length of guide element 21 is such that its downstream or trailing end guides the trailing end of the label at least until the label is completely wrapped around the container such that the overlap between the leading and trailing ends of the label is formed in the region 3 which is identified in FIG. 8.

Radially inwardly of the rotary plate 16 orbit 23 is a circular guide frame 28, shown in section, which holds radially reciprocable heat sealing members 22. Guide frame 28 rotates in synchronism with turntable 15. The number of heat sealing members 22 carried on guide frame 28 corresponds to the number of rotary plates 16 on turntable 15. The sealing members 22 are positioned to cooperate with the respective rotary plates 16. There is an electric heater cartridge 37 on each sealing member. Positioned inside of the guide frame 28 is a control device 24 which drives the heat sealing members 22 radially outwardly. Control device 24 comprises first and second superimposed radial cams 25 and 26 which are adjustable rotationally in relation to each other in the rotational direction of turntable 15 or in the opposite direction. Each heat sealing member 22 has on its radially inward end a guide roller 27 which is spring biased into contact with radial cams 25 and 26. The spring which holds each roller in contact with cams 25 and 26 is not shown.

The first or upper radial cam 25 of control device 24 is held stationary on a central machine support 31 in this embodiment while the lower or second radial cam 26 is rotationally adjustable about stationary center support 31 by means of an actuation device, not shown, between two limit positions. The upper or first radial cam 25 determines the beginning of the heat sealing step by forcing a heat sealing member 22 radially outwardly into contact with the label overlap, while the trailing edge of the lower or second radial cam 26 determines the end of the heat sealing step. Offsetting the lower cam 26 relative to the upper cam 25 enables the turntable rotational angle during which a heat sealing member 22 bears on the overlapping trailing and leading label ends in the region 3 of label 2 to be enlarged or reduced in size in proportion to the present rotational speed of turntable 15. Because the second or lower radial cam 26 is continuously adjustable within limits, the sealing time can be kept constant within limits by varying the control angle. In other words, the heat application angle is increased or largest when the output rate is high and is reduced as the output rate decreases.

Figure 9:
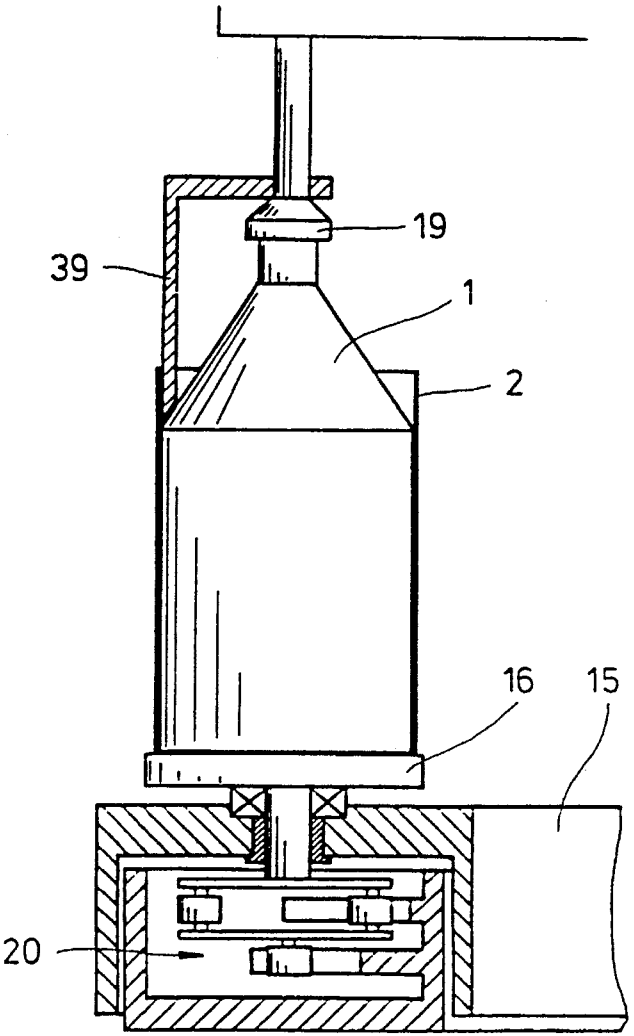
FIG. 9 shows a vertical section through the outer rim or periphery of the turntable of a labeling machine, such as in FIGS. 1–4, showing how the container is subjected to an axially downwardly applied axial force which holds it firmly to a rotating disk, this figure also illustrating how the upper longitudinal edge of a label which extends over the inwardly tapered part of the container is backed up with an element which prevents the upper edge of the label from collapsing inwardly when the overlap is being sealed.

The advancing edge of the first or upper cam 25 is positioned so that the sealing members 22 are pushed radially outwardly shortly before the trailing end of the fixed guide element 21 is reached and are applied to the overlapping end region 3 of a label 2 immediately beyond the end of guide element 21. The edge of the lower or second radial cam 26 begins shortly before the outfeed conveyor 18 is reached, and at the latest, so that the heat sealing members 22 can be pulled by spring action radially inwardly again to provide for removal of containers 1 from turntable 15 and for transferring of the containers to outfeed conveyor 18. At the moment transfer of a container from the turntable to the outfeed conveyor 18 occurs, the centering bell 19, depicted in FIG. 9, is lifted so that the container is free to be carried away on the outfeed conveyor.

The rotational or oscillation sequence of the container support plates 16 is such that a container 1 is set into rotary motion counter to the turntable 15 after passing the adhesive applicator 12 or upon reaching the label transferring vacuum cylinder 14, at the latest. After termination of the label wrapping step resulting from at least one complete revolution of the container, the rotary motion of the container relative to the turntable 15 stops for the sealing step with the overlapping label end region 3 pointing inwardly toward the sealing member 22 which is traveling along with it. In other words, the heat sealing member 11 is maintained in contact with the region 3 in which the leading end of the label is overlapped by the trailing end after the turntable orbits the container beyond guide 21. It should be remembered that the trailing end of the label will not have adhesive directly on it in the overlapping or sealing region and that the adhesive applied to the leading end is set back out of the overlapping region by a small amount.

Figure 2:
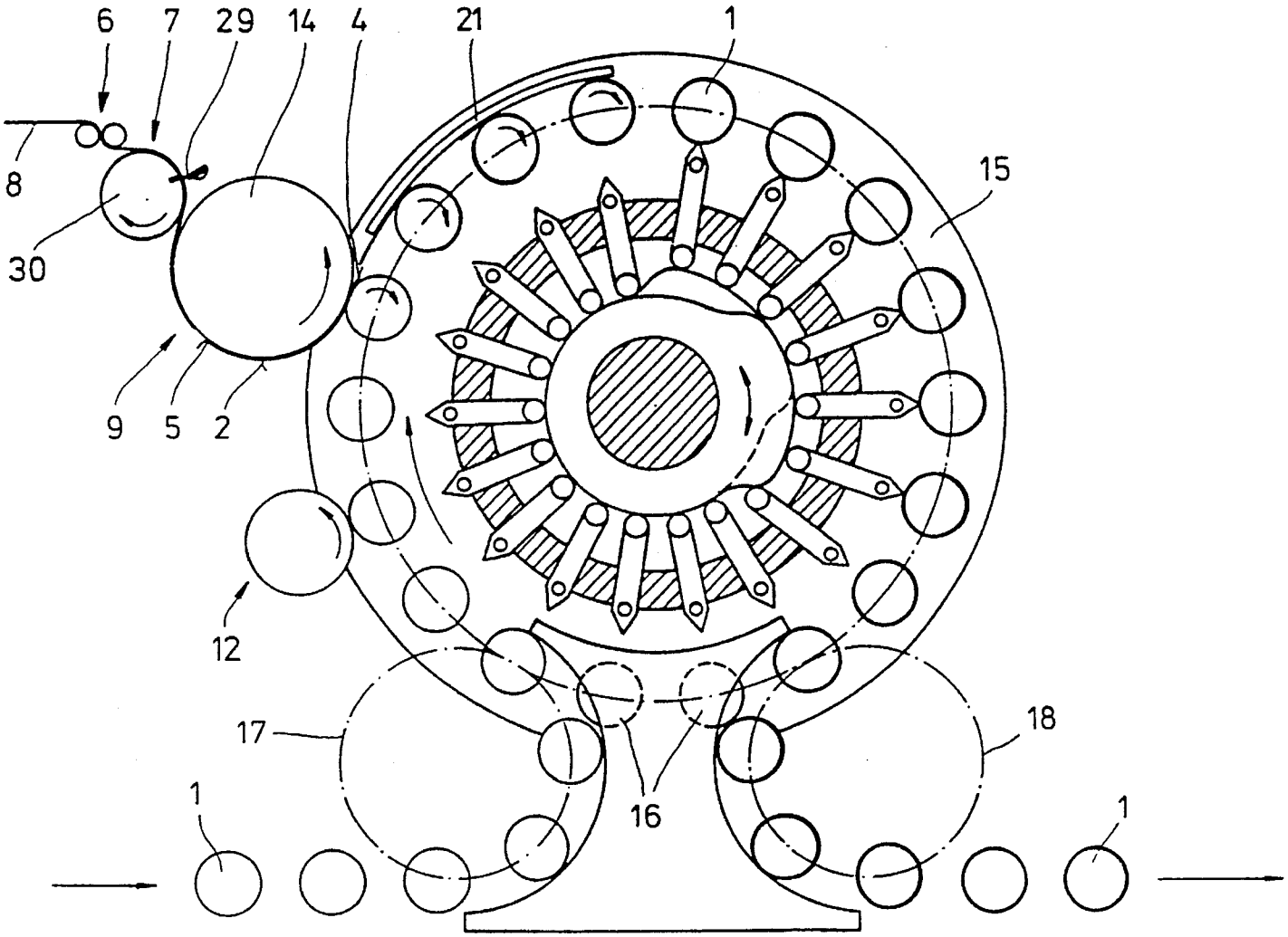

The alternative embodiment of the new labeling machine depicted in FIG. 2 is basically the same as that shown in FIG. 1 but differs in respect to the motion relationships in the area of the label transfer device 9 and in the wrapping of the labels around containers 1. In contrast to the FIG. 1 embodiment, the vacuum cylinder 14 in the FIG. 2 embodiment is driven counter-rotationally to the direction of turntable 15. In other words, in FIG. 2 the turntable 15 is rotating clockwise and the vacuum drum 14 is rotating counterclockwise. In this case, at the moment of label transfer from vacuum cylinder 14 to a container 1 and during subsequent wrapping of the label around the container, the container is moved by rotary plate 13 in the rotational direction of the turntable so that a container 1 is rolled slip-free on the vacuum cylinder 14 when the leading edge of the label is delivered. Because the containers 1 rotate in the same direction as the turntable 15 in the FIG. 2 embodiment, the stationary guide element 21 is positioned radially outwardly of the container orbit which is outlined by the dashed circular line 23.

The FIG. 2 embodiment makes it possible to process labels which are longer than those which can be handled in the FIG. 1 embodiment with a turntable 15 having the same divisional scale and it offers more favorable transfer conditions at the vacuum cylinder 14.

since the electrically heatable sealing members 22 are positioned radially inwardly of the rotary plate orbital path 23, as in the FIG. 1 embodiment, but the overlap region at the ends of label 2 point radially outwardly after wrapping the label, the container must be turned at least 180° for sealing, so that the overlapped region is positioned opposite of a heat sealing member 22. To prevent the trailing edge 5 of the label from falling off the container during the 180° of rotation, it must be attached to the container until the sealing member 22 is pressed against the label overlapping ends of the container. For instance, attachment of the trailing end of the label to the container can be achieved mechanically by a method, not shown, wherein a pressing or guiding element is provided for each rotary plate and container 1 thereon and revolves with them and is applied to the container at least by the time the container reaches the departing end of the stationary guide element 21, to hold the trailing part of the label 2 on the container until the overlap region 3 is aligned with and contacted with a sealing member 22. A pressing or guiding element, not shown, of this kind is mounted for radial movement on circular guide frame 28 and actuated by an associated control device, not shown, similar to the control device depicted in FIG. 9 for actuating heat sealing members 22.

Alternatively, the trailing edge 5 of the label 2 can be held on the container by attaching, the trailing edge similarly to the leading edge, but with a narrow adhesive region or points, applied before the overlap region 3 of the label 2 is secured by sealing. In other words, the adhesive dots or line is applied near the trailing edge but not so close to the trailing edge as to be coincident with any part of the area at the trailing edge which overlaps the leading edge. In comparison to the FIG. 1 embodiment, this modification requires no additional mechanical parts. When the leading edge 4 of the label is applied to container 1 by vacuum cylinder 14, the rotation of the container 1 with rotary plate 16 must merely be adjusted relative to rotation of the vacuum cylinder 14 in the area of the transfer device 9 so that leading edge 14 of the label does not completely cover the regions previously applied to the container by the adhesive applicator 12. Thus, that part of the leading edge of the label is free of adhesive. This not yet coated part of the adhesive region comes into contact with the label in the area of the trailing edge 5 of the label during subsequent wrapping but the overlapping region 3 is kept free of adhesive for subsequent heat sealing. (See FIGS. 6 and 8).

Figure 3:
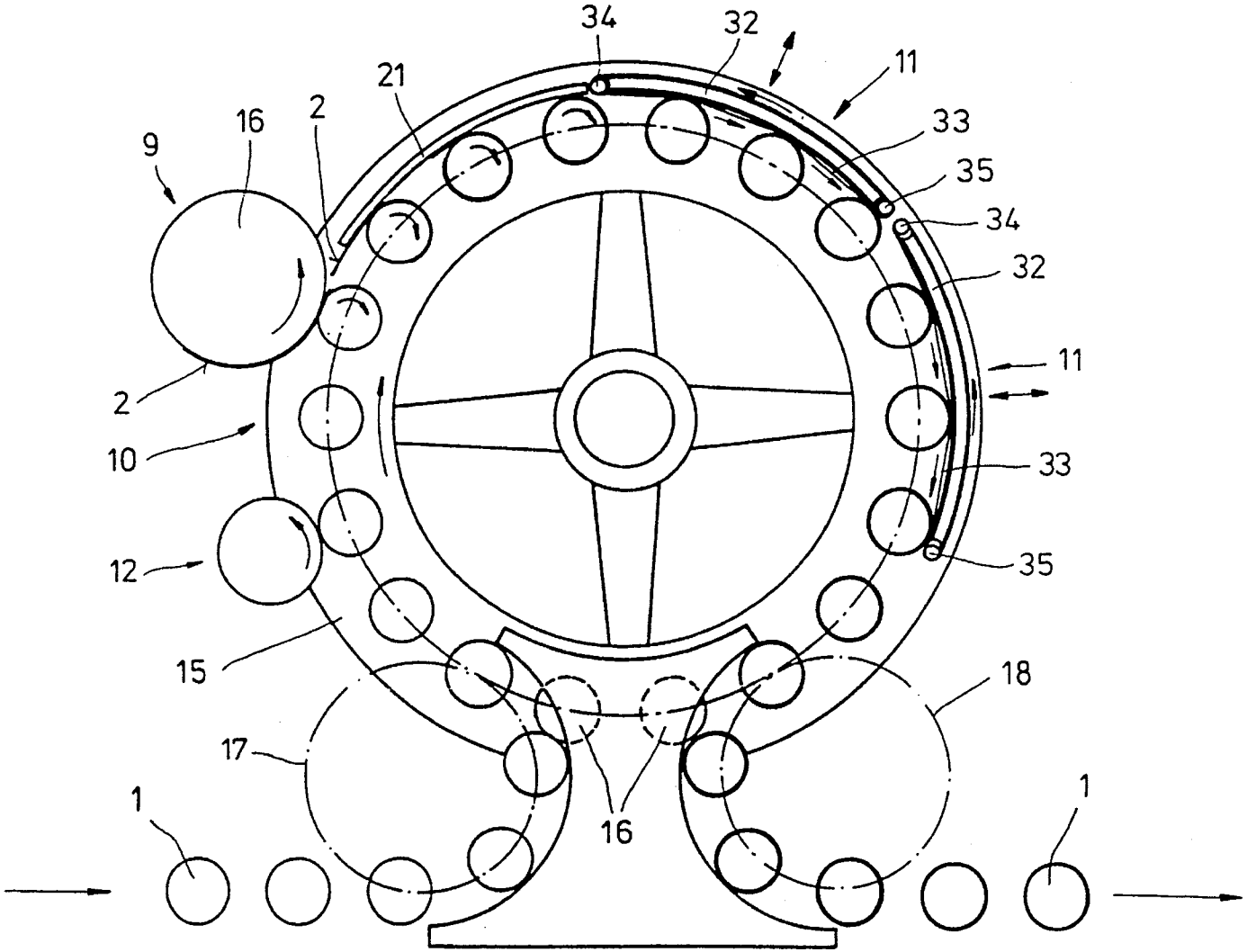

Another alternative embodiment is illustrated in FIG. 3. It differs from the FIG. 2 embodiment in that it has a different heat sealing device 11. The heat sealing device in FIG. 3 is a curved heating element 32 which is held stationarily radially outward of the orbital path 23 of the containers and is encircled by a thin, heat resistant but heat transmissive belt 33 of film-like material such as that which is known by the trademark TEFLON. The belt 33 is diverted or directed by deflection rollers 34 and 35 at each end of the heating element. The deflection roller 35 is driven rotationally synchronously with the current rotational speed of turntable 15 so that belt 33 bears against container 1 and travels slip-free with it.

The process of wrapping a label 2 on a container 1 in the FIG. 3 embodiment is the same as in the FIG. 2 embodiment, for example, until the aft end of the guide element 21 is reached. However, after wrapping a label on a container is complete, the rotary motion of container 1, activated by a control device 20 of the rotary container support plate 16, is stopped near the aft end of the guide element 21 so that the region 3 where the ends of the label overlap faces radially outwardly of the turntable and in this position is conducted past the heat sealing device or element 11 while the container is orbiting with the turntable but it is not rotating relative to the turntable.

As shown in the FIG. 3 embodiment, heat sealing can be apportioned between one or more heating elements 11 which are positioned in succession on the turntable adjacent the course 23 followed by the rotating containers. The heating elements can be shifted away from the containers radially outwardly with actuation devices, not shown, to adapt the sealing rate to different machine outputs. At full capacity, both heat sealing elements 11 assume their radial inside position, whereas at half capacity, for instance, one element 33 is shifted radially outward or deenergized to avoid overheating. This allows at least one-step adaptation of sealing time to different machine output. If the labeling machine should fail to stop because of a malfunction, all heat sealing members 11 can be shifted to the outer disengaged position simultaneously.

Figure 4:
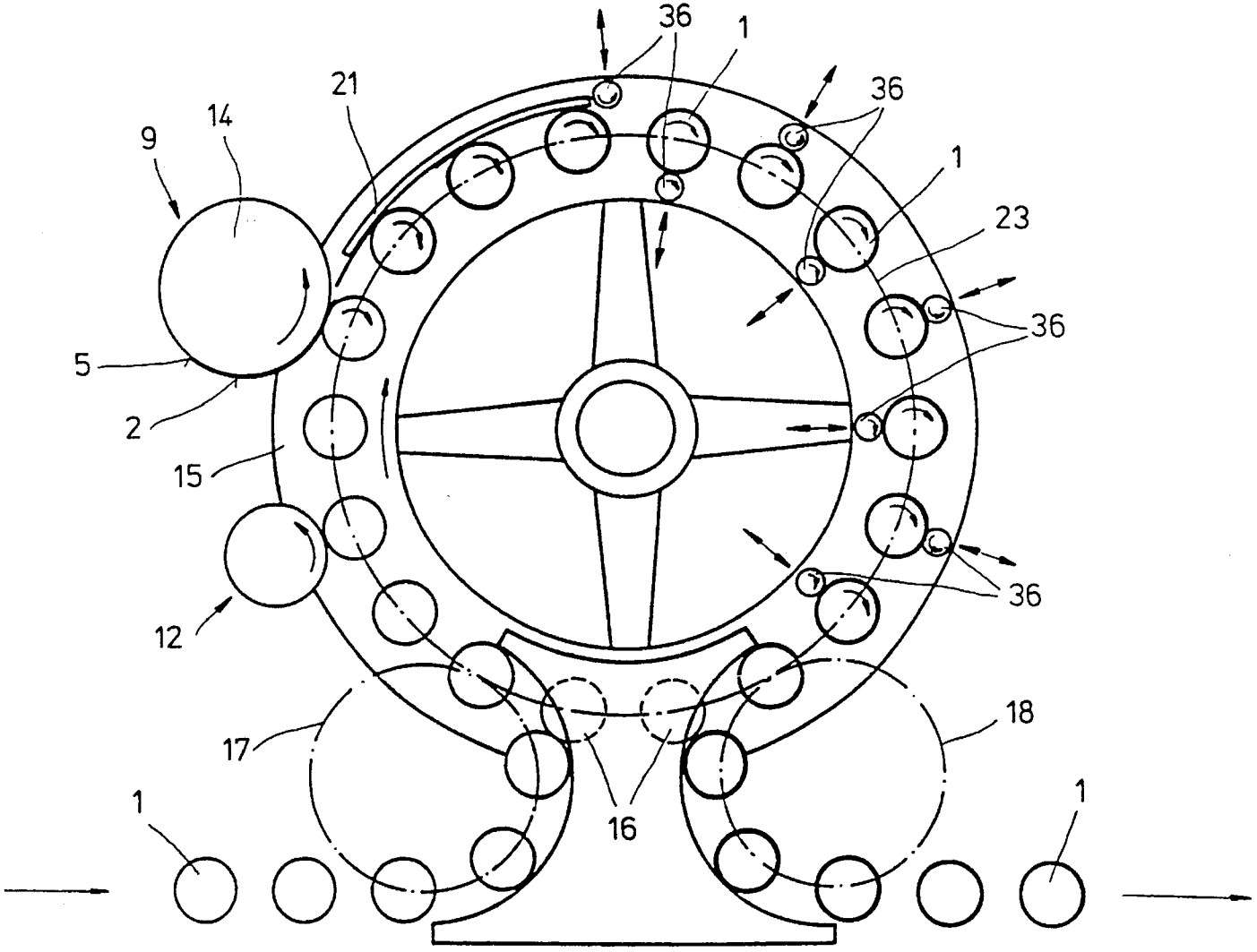

In the FIG. 4 embodiment of the labeling machine, the sealing device consists of several heated sealing rollers 36 positioned in staggered sequence inside and outside of the container orbit 23. In contrast to the previously described embodiments, the containers 1 are still continuously rotated about their own axes in the same direction by the control device for the rotary plate 16, even after completion of the wrapping process, as they travel through the sealing region. The stationary heatable sealing rollers 36 are positioned in staggered sequence on the turntable 15 so the overlapped region 3 is always briefly pressed by one of the sealing rollers 36 in alternation when it faces the respective radial inside or outside. To avoid slipping between the label surface and the surface of the sealing rollers 36, the rollers are driven synchronously with the speed of the label surface which is clinging to the container. By means, not shown in detail, the sealing rollers 36 can be drawn away from the containers radially inwardly or outwardly, respectively, so that the sealing time can be adapted to the present output of the labeling machine or to the operating speed of turntable 15 as is the case in the FIG. 3 embodiment.

Figure 5:
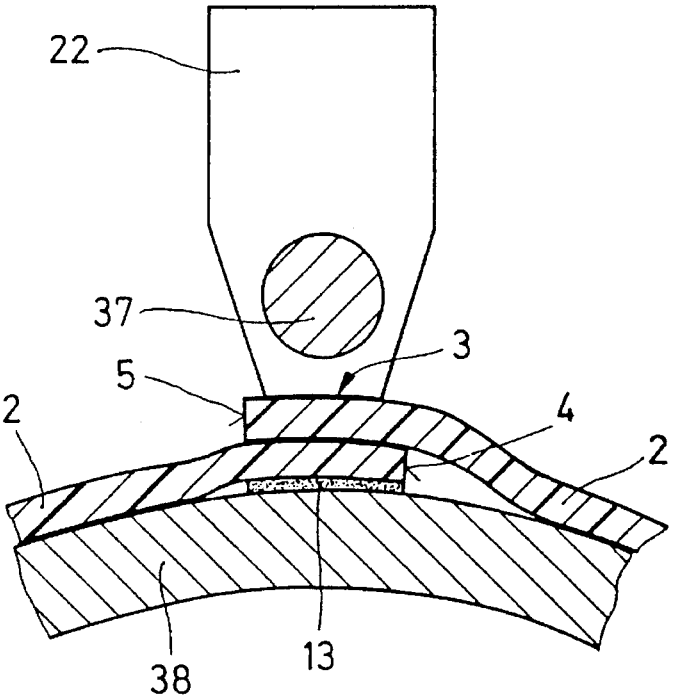
FIGS. 5–7 show cross-sections through the overlapping leading and trailing ends of a label container wherein there are, respectively, different adhesive patterns.
Figure 6:
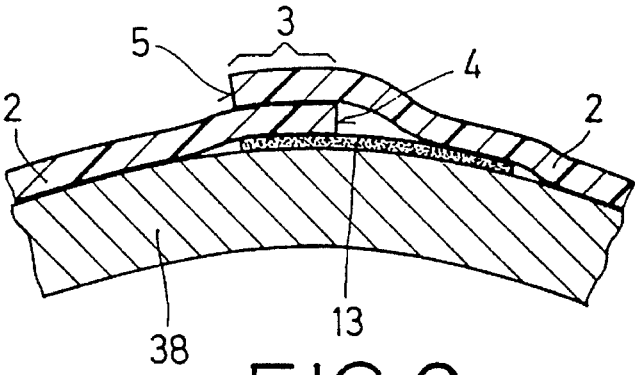
Figure 7:
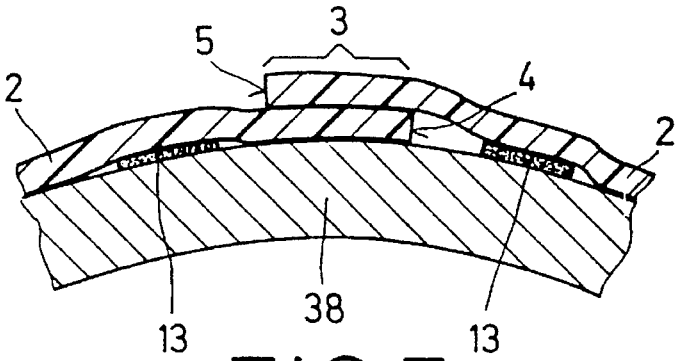

FIGS. 5–7 show a section through a part of a container where the leading and trailing ends of the label overlap. In these figures, sealing of the label ends is completed. The three embodiments in FIGS. 5–7 differ only in respect to the adhesive regions 13 used on the labels 2.

In the FIG. 5 option, only the leading edge 4 of the label is attached to the periphery or outside of the container wall 38 through narrow adhesive regions 13. The trailing end of the label is held to the leading end exclusively by the heat seal in the overlap region 3. It will be understood that the adhesive region 13 can be shifted laterally a certain distance from the leading edge of the label so it no longer lies directly in the overlapping region 3. As is also shown, the trailing edge 5 in FIG. 5 can be sealed to the leading edge of the label by a sealing member 22 that is movable radially in relation to container 1 and can be adjustably heated by previously mentioned rod-shaped electric heating cartridge 37. To prevent the label material from sticking to the sealing member 22 due to the heat of the sealing process, at least the part of the sealing member which interfaces with the label surface can desirably be coated with TEFLON. The sealing effect is influenced not only by the adjustable and controllable temperature of the sealing members 22 but also by the pressure of the members against the container. The sealing members 22 are therefore biased by springs, not shown, which at the same time compensate for tolerable variations in the diameters of the containers which may occur.

In the FIG. 6 embodiment, the adhesive region 13 holds not only the leading edge 4 but also the aft section of the label 2 in the vicinity of its trailing edge 5 to the container wall 38, although the overlap region 3 between the trailing edge 5 and leading edge 4 of the label remains free of adhesive. This is necessary to achieve a flawless seal. The adhesive pattern in FIG. 6 is also discernable in FIG. 8. It is not absolutely necessary that a continuous vertical line of adhesive be applied parallel to the leading edge 4 of the label to obtain satisfactory adhesion and wrapping. Two or three narrow, vertically aligned and slightly horizontally extending adhesive stripes or dots are sufficient. These can be applied with an adhesive roller 12 having radially projecting annular lands acting directly on the containers or with spray nozzles, not shown.

Figure 8:
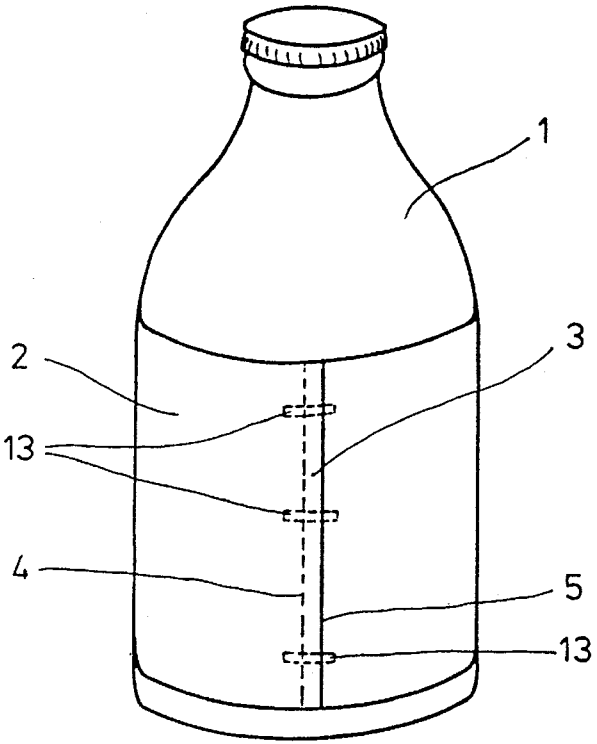
FIG. 8 is a perspective view of a label container which has an adhesive pattern on the label corresponding with the pattern shown in FIG. 6.

The application of adhesive only at certain points or dots, as indicated in FIG. 8, can also be used with the adhesive arrangement of FIGS. 5 and 7. FIG. 7 shows an adhesive pattern similar to that of FIG. 6 but differs in that no adhesive is applied between the leading edge 4 of the label and the container wall 38 in the overlapped region. Each adhesive region 13 is a certain distance from the leading edge 4 or the trailing edge 5 of the label. The advantage of this is, because there is no superimposed mass of material and adhesive, the overlapping region 3 lies tightly against the container wall 38 after it is sealed which makes a less visible or invisible seal.

The adhesive patterns of FIGS. 5–7 can be applied, not only directly onto the container, as shown in the FIGS. 1–4 embodiments, but also directly on the corresponding regions of the inside surface of the label. The adhesive roller or applicators required for this must then be positioned on the periphery of the vacuum cylinder 14. The separated individual labels 2 are held inside out on the vacuum cylinder. To obtain the adhesive pattern of FIG. 5, for example, the vacuum cylinder 14 may have radially movable slides, not shown, in proximity with the leading edge of the label so that a smooth adhesive roller with minimal radial interspace can be placed on the vacuum cylinder 14 to apply adhesive to the leading edge 4 of the label. These slides can also be used to transfer the leading edge 4 of the label from the vacuum cylinder 14 to the container 1 as the container is conveyed past it on the turntable 15.

In FIG. 8, the label 2 is attached to the container wall 38 of container 1 using the adhesive pattern of FIG. 6. Although the label 2 is held to the container wall 38 only at certain points by three narrow adhesive strips or dots 13 applied one above the other near the leading end of the label, the trailing end of the label is sealed continuously along its entire length to the leading end.

In processing containers having radially tapered sections at the top or bottom that are to be covered by a label that fits the container contour after the labeling process is complete, the label can be attached first directly to the cylindrical part with the narrow adhesive regions unwrapped by the previously described method. Then to seal the overlapped region, a support is needed on the inside of the overlap where it is not yet in contact with the outer container wall after wrapping so that it can be sealed along its entire length. After sealing, the extending portions of the label can be shrunk to the container contour by means of heat confined to the extending portions.

FIG. 9 shows a container 1 clamped axially between a rotary plate 16 and a centering bell 19 where the upper edge of the label extends upward beyond the cylindrical region of the container which is clamped between the top and bottom. To support the overlapped region 13 in this extending part of the label, a support surface designed in the form of a tongue 39 is mounted on the centering bell 19.

I claim:

1. A container having a cylindrical section, a label having a leading end portion and a trailing end portion and at least a strip of adhesive interposed between said leading end portion of said label and the container, said adhesive attaching said leading end portion of the label to said cylindrical section of the container, said label is wrapped around said container and said trailing end portion of the label overlaps said leading end portion and there is no adhesive between said leading and trailing end portions, and said trailing end portion is bonded by heat fusion to said leading end portion of said label.

2. A container according to claim 1 wherein said adhesive strip is long enough circumferentially of said cylindrical section of said container for a region of said label spaced from said trailing end portion of the label to overlay said adhesive and adhere to said container with the trailing end portion of said label being free of adhesive where said trailing end portion of said label overlaps said leading end portion of said label.

3. A container having a cylindrical section, a label having a leading end portion extremity and a leading end portion adjacent said extremity and at least a strip of adhesive interposed between said label adjacent said leading end portion and said container to adhere said label to said cylindrical section of said container without having adhesive between said leading end portion of said label and said container, said label having a trailing end portion extremity and a trailing end portion adjacent said extremity of said trailing end portion, said label is wrapped around said cylindrical section of said container with said trailing end portion superimposed on said leading end portion and a strip of adhesive is interposed between said label and said cylindrical section of said container adjacent said trailing end portion to adhere said label to said container, and said trailing end portion of said label is bonded exclusively to said leading end portion by heat fusion.

* * * * *